US012741789B2

(12) United States Patent
Hameau et al.

(10) Patent No.: US 12,741,789 B2
(45) Date of Patent: Sep. 22, 2026

(54) PACKAGING DEVICE

(71) Applicant: L'OREAL, Paris (FR)

(72) Inventors: Julien Hameau, Clichy (FR); Laurence Marchand, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 19/145,039

(22) PCT Filed: Jan. 11, 2024

(86) PCT No.: PCT/EP2024/050624
§ 371 (c)(1),
(2) Date: Jul. 1, 2025

(87) PCT Pub. No.: WO2024/149859
PCT Pub. Date: Jul. 18, 2024

(65) Prior Publication Data

US 2026/0015132 A1 Jan. 15, 2026

(30) Foreign Application Priority Data

Jan. 12, 2023 (FR) ..... 2300307

(51) Int. Cl.
*B65D 43/02* (2006.01)

(52) U.S. Cl.
CPC ..... *B65D 43/0231* (2013.01); *B65D 2543/00296* (2013.01); *B65D 2543/00407* (2013.01);
(Continued)

(58) Field of Classification Search
CPC ..... B65D 43/0231; B65D 2543/00296; B65D 2543/00407; B65D 2543/00537; B65D 2543/00972
(Continued)

(56) References Cited

U.S. PATENT DOCUMENTS 5,381,918 A 1/1995 Dahl
7,721,901 B1 5/2010 Von Spreckelsen
(Continued)

FOREIGN PATENT DOCUMENTS

WO 2021076874 A1 4/2021

OTHER PUBLICATIONS

International Search Report (ISR) for PCT/EP2024/050624 mailed Mar. 25, 2024 (4 pages).

*Primary Examiner* — Jacob K Ackun
(74) *Attorney, Agent, or Firm* — Jason A. Smith; Shumaker, Loop & Kendrick, LLP

(57) ABSTRACT

Device (1) for packaging a product, comprising:
- a container (2),
- a closure lid (3),
- a seal (70), the lid (3) comprising:
- a cover (10),
- a cap (20), fixed inside the cover, and comprising:
  - a mounting skirt (21),
  - a perforated upper wall (22), comprising
    - a peripheral annular portion (25) connecting to the mounting skirt (21),
    - a central portion (23),
    - at least five arms (24) connecting the central portion (23) to the annular portion (25) and leaving apertures (26) between them, these arms in cross section having a shape factor, defined by the ratio L/e, where L denotes the width of the arm and e the thickness thereof, of between 1 and 2.

12 Claims, 5 Drawing Sheets

(52) U.S. Cl.
CPC ..... *B65D 2543/00537* (2013.01); *B65D 2543/00972* (2013.01)

(58) Field of Classification Search
USPC ..... 220/304
See application file for complete search history.

(56) References Cited

U.S. PATENT DOCUMENTS

| | | | | |
|---|---|---|---|---|
| 8,881,929 | B2 | 11/2014 | Ekkert et al. | |
| 2012/0285965 | A1* | 11/2012 | Ekkert | B65D 43/0231 215/350 |
| 2016/0083150 | A1* | 3/2016 | Diminick | B65D 1/40 220/288 |
| 2020/0253426 | A1* | 8/2020 | Terakawa | B65D 51/18 |
| 2025/0108966 | A1* | 4/2025 | Harper | B65D 43/0231 |

* cited by examiner

[Fig 1]
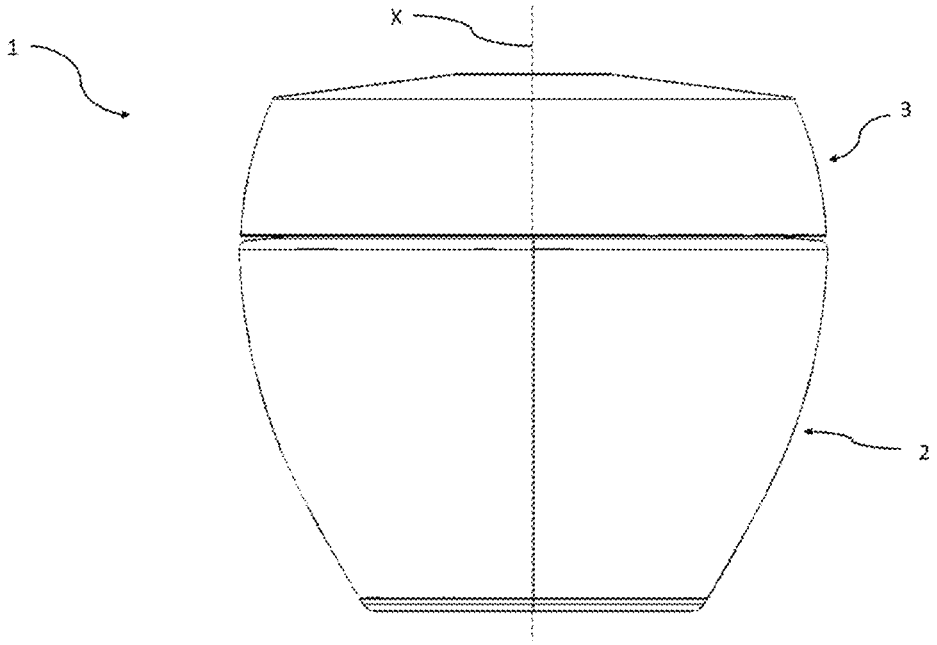

[Fig 2]
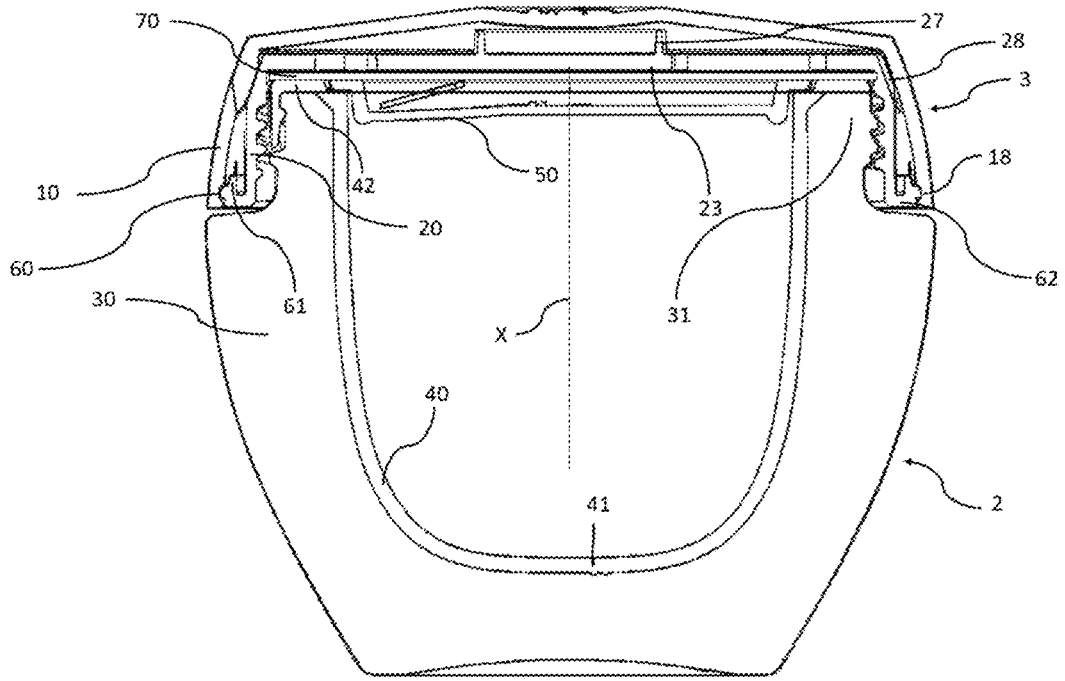
[Fig 3]
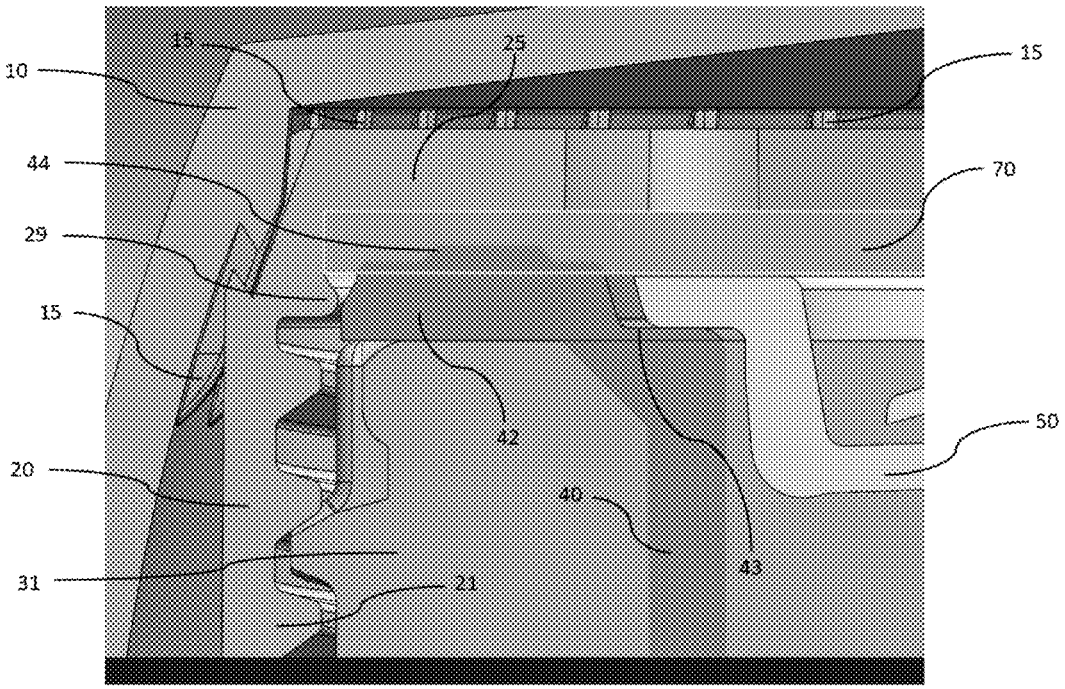

[Fig 4]
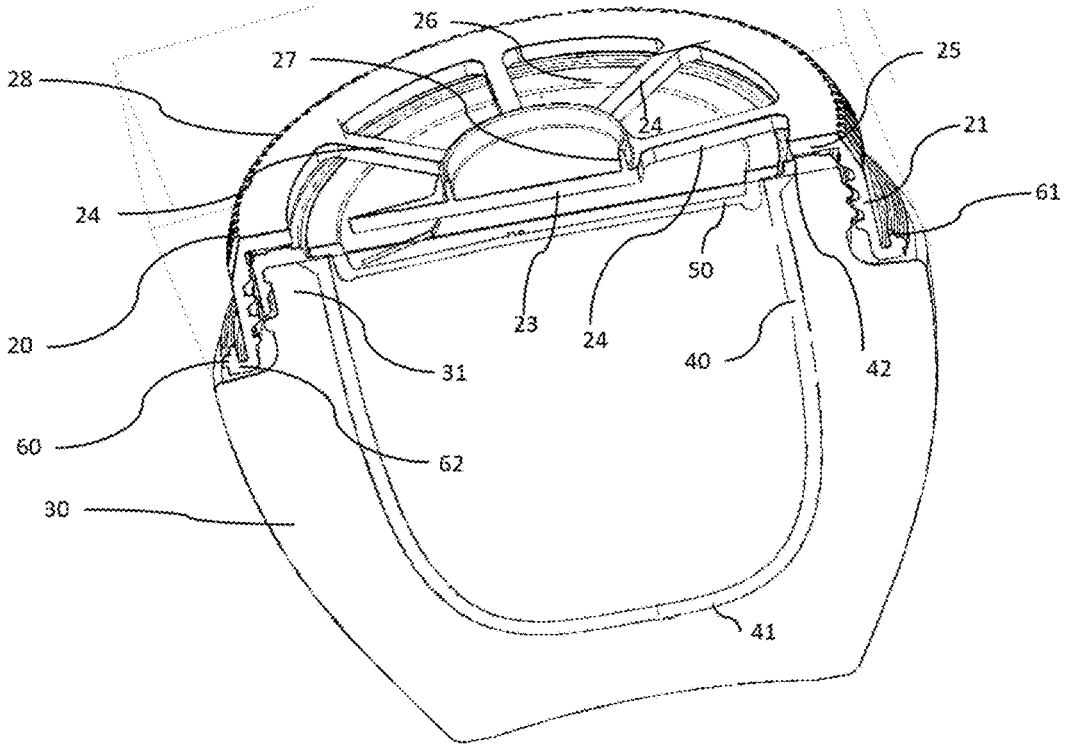
[Fig 5]
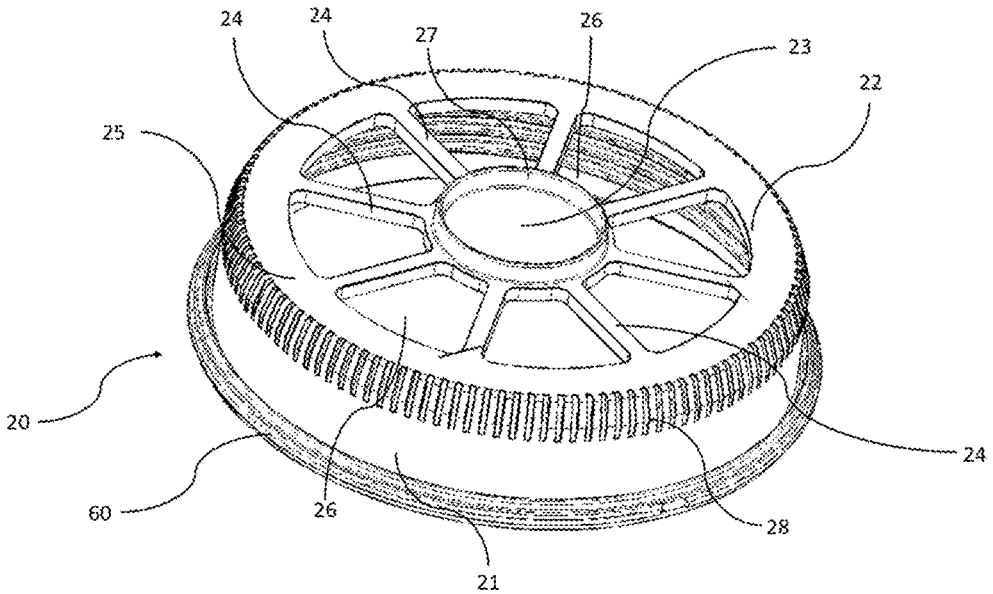

[Fig 6]
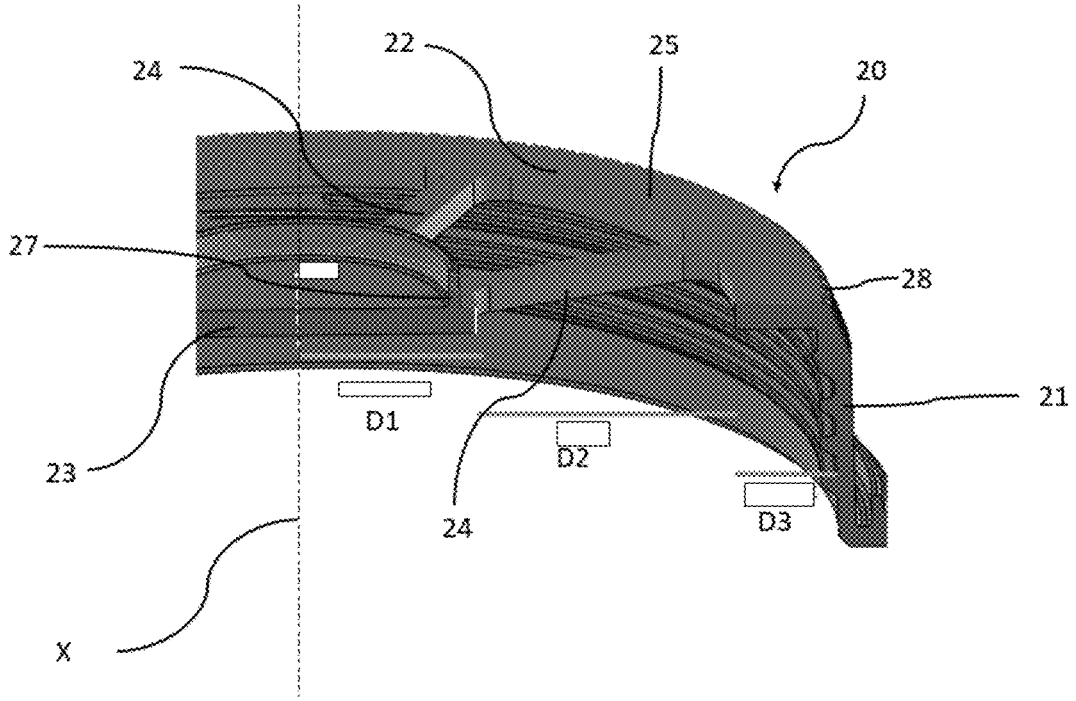

[Fig 7]
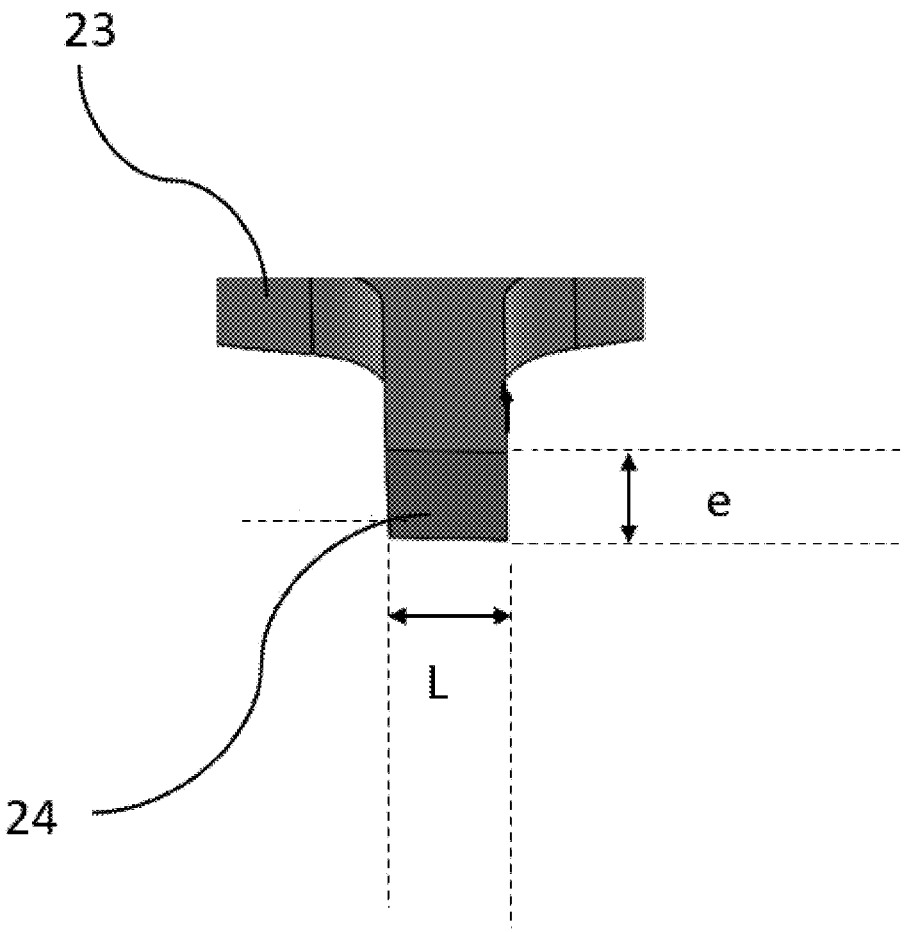

PACKAGING DEVICE

TECHNICAL FIELD

The present invention relates to packaging devices comprising a container provided with a threaded neck, and a container-closing lid designed to be screwed onto the neck.

PRIOR ART

It is known practice to make the lid as two parts, namely an outer cover providing the desired aesthetic appearance, and an insert formed by an inner cap fixed inside the outer cover, and closing and sealing same.

This inner cap is created by injection-moulding a thermoplastic, and comprises an internally threaded mounting skirt, used for screwing the lid onto the neck of the container, and a solid upper wall connecting at its periphery to the upper end of the mounting skirt.

The container may be produced with a hollow outer body, which defines the neck, and a removable inner part, housed inside the body and that can be replaced with a new one once its contents have been used up.

This inner pot at its upper end has an annular rim that comes to press against the end edge face of the neck.

A disc-shaped seal is housed in the closed end of the cap so as to be clamped between the upper wall of the cap and the rim of the inner pot when the lid is closing the container.

Proposing environmentally friendly eco-responsible solutions, the design and development of which take account of environmental considerations, is becoming a major preoccupation in contributing to overcoming the challenges facing our planet.

It has become apparent that it is therefore essential to design products that make it possible to reduce the amount of materials used and/or to substitute more environmentally friendly materials and/or to use recyclable materials so as to reduce the carbon footprint of the product.

In the case of a closure lid as defined above, this reduction in the carbon footprint may involve reducing weight of the closure cap.

However, such weight reduction is subject to a number of constraints.

First of all, the lid needs to remain functional, namely to maintain its function of closing and sealing the container.

In addition, the weight reduction needs to not lead to manufacturing difficulties liable to affect the quality of the parts, notably a risk of air becoming trapped in the mould at the time of injection.

Finally, it is desirable to limit, as much as possible, any modifications made to installations already in place.

In the case of the above-mentioned cap, attempts have been made at reducing weight by reducing the thickness of the upper wall; however, such a reduction is accompanied by a significant increase in the injection pressure, and this increases the amount of energy consumed in the manufacture and may lead to a need to re-engineer the injection moulding press.

U.S. Pat. No. 8,881,929 describes a packaging device comprising a container having a threaded neck, onto which is screwed a lid formed from a perforated cap onto which a stopper is clip-fastened. The cap comprises a cross-shaped grating, the purpose of which is to limit the outward deformation of a film seal positioned between the upper end of the neck and the cap, this deformation occurring under the effect of a pressure differential between the inside of the container and the outside after the operation of hot-filling the container.

DISCLOSURE OF THE INVENTION

There is still a need to lighten the weight of the cap used to close a packaging device of the above type, comprising a closure lid housing a seal.

SUMMARY OF THE INVENTION

The invention aims to meet this need by proposing a device for packaging a product, comprising:

- a container provided with a threaded neck,
- a closure lid designed to screw onto the neck of the container,
- a seal placed inside the lid, the lid comprising:

- an outer cover,
- an inner cap formed by injection-moulding of a thermoplastic, fixed inside the outer cover, and comprising:
  - an internally threaded mounting skirt designed to screw onto the neck of the container,
  - a perforated upper wall, comprising
    - a peripheral annular portion connecting to the mounting skirt, this annular portion coming to press against the seal at the end of the screwing of the lid onto the container, the seal being interposed between the container and the cap when the lid is closing the container,
    - a central portion,
    - at least five arms connecting the central portion to the annular portion and leaving apertures between them, these arms in cross section having a shape factor, defined by the ratio L/e, where L denotes the width and e the thickness, of between 1 and 2.

The invention makes it possible to significantly lighten the weight of the cap while keeping it functional.

The number and layout of the arms, together with the shape factor of the cross section thereof, limits the zones in which an air bubble might be likely to become trapped, thereby ensuring good quality manufacture, and allows the thermoplastic to be injected into the mould without the need to significantly increase the injection pressure.

The central portion contributes to holding the seal on the cap when the lid is unscrewed. The seal may be fixed, notably bonded, at its centre, to this central portion.

As a variant or in addition, the seal may be fixed by clip-fastening inside a peripheral groove formed in the mounting skirt of the cap, notably at the junction between this skirt and the peripheral annular portion of the upper wall. In particular, the peripheral groove for clip-fastening the seal is defined by the peripheral annular portion of the upper wall, the mounting skirt, and a peripheral bead that projects radially inwards from the mounting skirt.

As a variant or in addition, the seal may be fixed, notably bonded, to the peripheral annular portion of the upper wall of the cap and/or to the arms of the perforated upper wall.

The seal is formed for example by a disc of a thickness of between 1 mm and 1.5 mm, notably of around 1.2 mm.

The seal may notably be made from an elastomer or from a plastic, particularly an expanded plastic such as expanded polyethylene (PE). The trade name TRESYLENE® is one example of an expanded polyethylene (PE) that can be used to make the seal. More generally, the seal may be made from any material capable of sealing the container and preserving the product contained therein, once it has been compressed between the neck of the container and the peripheral annular portion of the upper wall of the cap, at the end of the screwing of the lid onto the container.

The length of the arms can represent between 40 and 60%, better still between 45 and 55%, of the largest internal radius of the mounting skirt.

The largest internal radius of the mounting skirt is that measured at the base of the screw thread.

The largest radius of the central portion can represent between 15 and 40%, better still between 20 and 35%, of the largest internal radius of the mounting skirt.

As a preference, the central portion has a circular contour. If, however, the contour is non-circular, the largest radius of the central portion is that of the circle circumscribing the central portion.

The width of the peripheral annular portion can represent between 10 and 35%, better still between 15 and 30%, of the largest internal radius of the mounting skirt. Such a width of the annular portion makes it possible to ensure retention of the seal and press it against the container in a particularly satisfactory manner.

All of the above relative dimensions together contribute to further improving the flow of the material in the mould and to reducing the risk of air bubbles becoming trapped during manufacture.

The shape factor of the cross section of the arms is preferably between 1.1 and 1.4, better still between 1.2 and 1.3.

The arms are advantageously radial, affording a star-shaped arrangement.

In a preferred embodiment, the arms are eight in number, oriented at 45° from one another.

As a preference, the central portion is solid, thereby allowing the material to flow properly as the mould is filling.

The central portion and the arms preferably have a thickness of between 1.1 and 2 mm, better still of between 1.5 and 1.7 mm. A thickness greater than 1 mm makes it possible to reduce the injection pressure, and a thickness of between 1.5 and 1.7 makes it possible to optimize the saving on material and the injection pressure.

The container may comprise a hollow body defining the neck and an inner pot housed inside the body. That allows the inner pot to be replaced easily and used as a refill. The outer body may thus be reused.

As a preference, the inner pot comprises a rim coming to press against the edge face of the neck, the seal being interposed between said rim and the annular portion of the cap when the lid is closing the container.

The inner cap may have at least one catching relief designed to hold the cap in place in the outer cover, the catching relief preferably being formed by a bulge borne by an annular lip concentric with the mounting skirt and connected to the base of the mounting skirt by an inwardly directed return.

BRIEF DESCRIPTION OF THE DRAWINGS

The invention may be understood better from reading the following detailed description of a nonlimiting exemplary embodiment thereof, and from studying the appended drawing, in which:

FIG. 1 shows an elevation view of an example of a packaging device according to the invention, FIG. 2 is a longitudinal section through the device of FIG. 1, FIG. 3 shows a detail of the device, FIG. 4 is a perspective view, with longitudinal section, with the outer cover and the seal removed, FIG. 5 shows the inner cap, on its own, viewed in perspective, FIG. 6 is a view in partial section of the cap, and FIG. 7 depicts one of the arms in cross section.

DETAILED DESCRIPTION

The packaging device 1 depicted in FIG. 1 comprises a container 2 containing a product that is to be applied, for example a cosmetic makeup or care product, for example a moisturizing or anti-ageing cream, and a closure lid 3 that can be screwed onto the container.

The lid 3 comprises, as may be seen in FIGS. 2 to 4 in particular, an outer cover 10 and an inner cap 20 fixed inside this cover.

The container 2 comprises a body 30 having an externally threaded neck 31 at its upper part. The body 30 is for example made of glass, ceramic, metal, wood or plastic.

The body 30 is hollow and defines a housing to accommodate an inner pot 40 which contains the product, this pot 40 being made for example of thermoplastic.

The pot 40 may, as illustrated, have a rounded bottom 41 and, at the opposite end, an opening bordered by a rim 42 that comes to press on the top of the neck 31.

The rim 42 may connect to the rest of the pot while forming an annular discontinuity 43 which acts as a seat for a removable stopper 50 which can be removed by the user in order to access the product and refitted thereafter, before re-closing the container.

An annular rib 44 may project from the top of the rim 42, as is more particularly visible in FIG. 3. Such an annular rib 44 is advantageously intended for attaching a film seal intended to seal the inner pot, particularly when the latter is marketed in the form of a product refill.

The inner cap 20 comprises an internally threaded mounting skirt 21, of axis X, designed to screw onto the neck 31.

The mounting skirt 21 is connected at the top to a perforated upper wall 22 which extends perpendicular to the axis X.

The wall 22 comprises a central portion 23 which is connected by radial arms 24, of which there are eight in the example illustrated, to a peripheral annular portion 25 which extends continuously as far as the mounting skirt 21.

The arms 24 extend at 45° from one another, and form apertures 26 between them.

Each arm 24 advantageously, as visible in FIG. 7 in particular, has a rectangular cross section of width L greater than the thickness e, the ratio L/e being preferably of the order of 1.25; in the example illustrated, L is equal to 2 mm and e to 1.6 mm. The transverse wall 22 has the same thickness e at the annular portion 25 and at the central portion 23.

If reference is made to FIG. 6 it may be seen that the central portion 23 has a radius D1 which preferably represents between 20 and 35% of the largest inner radius of the mounting skirt 21, the arms 24 a length D2 of the order of 50% and the peripheral portion 25 a width D3 of between 15 and 30%.

The central portion 23 may bear an annular rib 27 directed towards the cover.

Rotation-proofing teeth 28 may be formed on an external chamfer present at the junction where the mounting skirt 21 meets the upper wall 22, these teeth 28 collaborating with ribs 15 formed on the interior surface of the cover 10, as visible in FIG. 3 in particular, so as to block the cap 20 against rotating in the cover 10.

In the example illustrated, the cap 20 is fixed in the outer cover by clip-fastening.

For this purpose, the cap 20 has an annular clip-fastening bulge 60 borne by an annular lip 61 concentric with the mounting skirt 21 and extending around same. The lip 61 is connected to the base of the skirt 21 by an inwardly directed return 62.

The cover 10 has an annular groove 18 into which the bulge 60 clip-fastens.

A seal 70 is placed in the closed end of the cap 20, against the upper wall 22, as illustrated in FIGS. 1 and 2.

When the lid 3 is screwed onto the neck 31, the seal 70 is compressed between the rib 44 of the rim 42 and the annular portion 25, thereby providing sealed closure.

When the lid 3 is removed, the seal 70 remains in the closed end of the cap 20.

In the exemplary embodiment illustrated, the seal 70 is fixed by clip-fastening inside a peripheral groove formed in the mounting skirt 21 of the cap, notably at the junction between this skirt and the peripheral annular portion 25 of the upper wall 22. In particular, and as visible in FIG. 3, the peripheral groove for clip-fastening the seal 70 is defined by the peripheral annular portion 25 of the upper wall 22, the mounting skirt 21, and a peripheral bead 29 that projects radially inwards from the mounting skirt.

As a variant or in addition, the seal 70 may be fixed, notably bonded, at its centre, to the central portion 23, at its periphery, to the peripheral annular portion 25 and/or to the arms 24 of the perforated upper wall 22.

EXAMPLES

Example 1 (Comparative)

Manufacture is simulated by injecting a reduced-weight cap having a non-perforated upper wall 1 mm in thickness, made from polypropylene (PP). The mass obtained is 6.82 g.

Example 2 (According to the Invention)

This same polypropylene (PP) is used to injection-mould a cap according to the invention, having a perforated upper wall as described hereinabove, with a material thickness of 1.6 mm, and eight arms of a width L of 2 mm. The cap has a mass of 6.3 g. The injection pressure is reduced by 27% compared with the comparative example.

It may be noted that the cap provides good retention of the seal and offers the desired level of sealing, while at the same time reducing the carbon footprint on account of the lower quantity of material used.

Of course, the invention is not limited to the example which has just been described. The cap may be fixed in the outer cover in a different way, for example. The rib 27 may be omitted.

The invention claimed is:

1. A device for packaging a product, comprising:
- a container provided with a threaded neck,
- a closure lid designed to screw onto the neck of the container,
- a seal placed inside the lid, the lid comprising:
- an outer cover,
- an inner cap formed by injection-moulding of a thermoplastic, fixed inside the outer cover, and comprising:
  - an internally threaded mounting skirt designed to screw onto the neck of the container,
  - a perforated upper wall, comprising
    - a peripheral annular portion connecting to the mounting skirt, this annular portion coming to press against the seal at the end of the screwing of the lid onto the container, the seal being interposed between the container and the cap when the lid is closing the container,
    - a central portion,
    - at least five arms connecting the central portion to the annular portion and leaving apertures between them, these arms in cross section having a shape factor, defined by the ratio L/e, where L denotes the width of the arm and e the thickness thereof, of between 1 and 2.

2. The device according to claim 1, the length of the arms representing between 40 and 60%, better still between 45 and 55%, of the largest internal radius of the mounting skirt.

3. The device according to claim 1, the largest radius of the central portion representing between 15 and 40%, better still between 20 and 35%, of the largest internal radius of the mounting skirt.

4. The device according to claim 1, the width of the peripheral annular portion representing between 10 and 35%, better still between 15 and 30%, of the largest internal radius of the mounting skirt.

5. The device according to claim 1, the shape factor of the cross section of the arms being comprised between 1.1 and 1.4, and better still between 1.2 and 1.3.

6. The device according to claim 1, the arms being radial.

7. The device according to claim 1, the arms being eight in number, oriented at 45° from one another.

8. The device according to claim 1, the central portion being solid.

9. The device according to claim 1, the central portion and the arms having a thickness e of between 1.1 and 2 mm, better still of between 1.5 and 1.7 mm.

10. The device according to claim 1, the container comprising a hollow body defining the neck and an inner pot housed in the body.

11. The device according to claim 10, the inner pot comprising a rim coming to press against the edge face of the neck, the seal being interposed between said rim and the annular portion of the cap when the lid is closing the container.

12. The device according to claim 1, the inner cap having at least one catching relief designed to hold the cap in place in the outer cover, the catching relief preferably being formed by a bulge borne by an annular lip concentric with the mounting skirt and connected to the base thereof by an inwardly directed return.

* * * * *